United States Patent [19]

Koch et al.

[11] Patent Number: 4,734,063

[45] Date of Patent: Mar. 29, 1988

[54] RADIALLY RESILIENT ELECTRIC SOCKET

[75] Inventors: Joseph J. Koch, 35724 Jefferson Ave., Mt. Clemens, Mich. 48045; Richard N. Koch, 22564 Statler, St. Clair Shores, Mich. 48081; Peter H. Vandekerkhof, Richmond, Mich.

[73] Assignees: Joseph J. Koch, Mt. Clemens; Richard N. Koch, St. Clair Shores, both of Mich.

[21] Appl. No.: 36,906

[22] Filed: Apr. 10, 1987

Related U.S. Application Data

[63] Continuation-in-part of Ser. No. 824,116, Jan. 30, 1986, Pat. No. 4,657,335.

[51] Int. Cl.[4] ..... H01R 13/11

[52] U.S. Cl. ..... 439/844

[58] Field of Search ..... 439/819–824, 439/840–859

[56] References Cited

U.S. PATENT DOCUMENTS

| | | | |
|---|---|---|---|
| 1,833,145 | 11/1931 | Wilhelm | 339/256 |
| 3,396,364 | 8/1968 | Bonhomme | 339/217 |
| 3,470,527 | 9/1969 | Bonhomme | 339/256 |
| 3,517,374 | 6/1970 | Bonhomme | 339/176 |
| 3,557,428 | 1/1971 | Bonhomme | 29/203 |
| 3,626,361 | 12/1971 | Bonhomme | 339/217 S |
| 3,641,483 | 2/1972 | Bonhomme | 339/217 |
| 3,686,622 | 8/1972 | Bonhomme | 339/217 R |
| 3,808,589 | 4/1974 | Bonhomme | 339/217 S |
| 3,858,962 | 1/1975 | Bonhomme | 339/256 |
| 4,203,647 | 5/1980 | Bonhomme | 339/256 |

*Primary Examiner*—Joseph H. McGlynn
*Attorney, Agent, or Firm*—Basile and Hanlon

[57] ABSTRACT

Various methods and techniques for making barrel terminals are disclosed, all of which are based upon the initial formation of the terminal contactor strips as an integral flat sheet metal blank produced by a conventional stamping operation. The contactor strips may thus be maintained in a predetermined relationship with each other and manipulated as a unit through successive assembly steps well adapted to be performed by automated tooling.

Several contactor strip blank configurations are disclosed, together with assembly methods for forming and assembling the blanks into completed barrel terminals.

11 Claims, 30 Drawing Figures

RADIALLY RESILIENT ELECTRIC SOCKET

REFERENCE TO RELATED APPLICATION

This application is a continuation-in-part of our copending application Ser. No. 824,116, filed Jan. 30, 1986, now U.S. Pat. No. 4,657,335.

BACKGROUND OF THE INVENTION

In the above-identified parent application, there is disclosed one embodiment of a radially resilient electrical socket of the type sometimes referred to as a barrel terminal and a method for making the barrel terminal disclosed in that application.

In barrel terminals of the general type with which the present invention is concerned, contactor strips or wires are stretched and extend through the interior of a cylindrical sleeve from a first circumferential location at one end of the sleeve to a second circumferential location at the opposite end of the sleeve which is angularly displaced about the sleeve axis from the first circumferential location. A plurality of such strips so mounted within a cylindrical sleeve collectively lie on a surface of revolution of a generally hourglass shape whose diameter varies from a minimum diameter midway between the ends of the sleeve and a maximum diameter at the ends of the sleeve. When a cylindrical electric contact of a diameter intermediate the minimum and maximum diameters referred to above is axially inserted into such a barrel terminal, the contactor strips will collectively exert a radially resilient grip upon the contact.

Prior art barrel terminals have proven extremely difficult to manufacture. Generally speaking the terminals have either been designed to be formed from a single piece of material (see Bonhomme U.S. Pat. Nos. 3,396,364 and 3,641,483) or to be built up or assembled from parts which include a plurality of individual contactor strips or wires (see Bonhomme U.S. Pat. Nos. 3,557,428 and 4,203,647). Where the terminal is formed from a one piece member, several rather complex machining and forming steps are required, while the construction of a barrel terminal starting with individial contactor strips involves a painfully tedious assembly process.

In our aforementioned parent application, there is disclosed a barrel terminal which can be readily contructed on a mass production basis from four basic parts-namely a cylindrical sleeve, a stamped sheet metal blank and a pair of annular rings which can be readily assembled in five simple steps.

The present invention is directed to additional embodiments of barrel terminals employing the basic concepts disclosed in the parent case, together with improved techniques for assembling such terminals.

SUMMARY OF THE INVENTION

In common with the barrel terminal disclosed in our aforementioned parent application, the various embodiments of barrel terminals of the present application are all so designed that the contactor strips for each terminal are initially formed by stamping a flat sheet metal blank in a manner such that all of the contactor strips are integrally connected in fixed relationship to each other by one or more connecting webs. This enables all of the individual contactor strips to be manipulated as a single unit through the assembly process.

Various forms of contactor strip blanks are disclosed, together with assembly methods particularly adapted to the particular forms of blanks.

In all embodiments, the contactor strips are initially formed by a stamping operation which forms a flat metal blank with a plurality of spaced parallel elongate contactor strips connected to each other at or near one or both ends by a transversely extending connecting web integral with the strips. In one embodiment, the connecting web takes the form of a rectangular member with the contactor strips projecting perpendicularly from one edge of the member. In this particular embodiment, the rectangular member is then folded along a fold line parallel to the edge from which the contactor strips project into face-to-face engagement with the contactor strips and the folded blank is then formed into a cylindrical tube with the rectangular memeber at the outside of the cylinder to function as the cylindrical sleeve of the completed barrel terminal.

In another embodiment, a rectangular blank is stamped with connecting webs extending along two opposite sides of the blank and spaced parallel contactor strips extend from one connecting web to the opposite connecting web. Two versions of this particular embodiment are disclosed. In one of these versions, score lines are formed in one of the connecting webs. The blank is then formed into a hollow cylindrical tube and inserted into a close fitting cylindrical sleeve. The unscored connecting web is axially aligned with one end of the sleeve and welded to the sleeve, while the scored connecting web is projected axially from the opposite end of the sleeve. The scored web is then radially expanded to break the connecting web apart along each score line so that the projecting portions of the strip may in a subsequent step of the assembly process, be reversely bent around the end of the sleeve to lie flat against the exterior surface of the sleeve.

In a second version, both connecting webs are scored and so located as to project beyond both opposite ends of the sleeve.

In another embodiment, a sheet metal blank is stamped with a single connecting web extending transversely of and integrally joined to the elongate contactor strips at a location spaced inwardly from one end of the blank.

All of the various contactor strip blanks referred to above may, when stamped, be integrally connected to a carrying strip in uniformly spaced relationship so that the blanks may be successively advanced by the strip, in step by step movement to and through a series of work stations at which various assembly steps are performed.

Other objects and features of the invention will become apparent by reference to the following specification and to the drawings.

IN THE DRAWINGS

Figure 19:
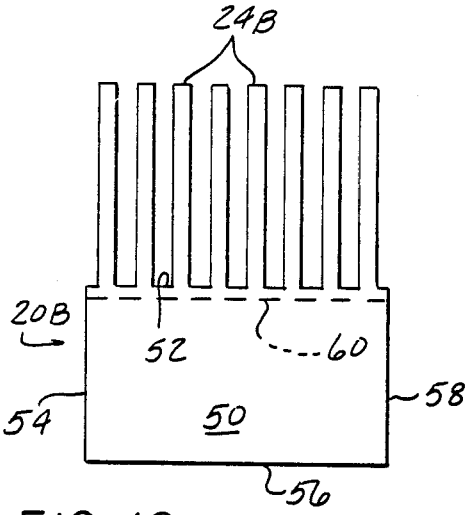
FIG. 19 is a top plan view of another form of flat sheet metal blank for constructing another form of barrel termimal.
Figure 26:
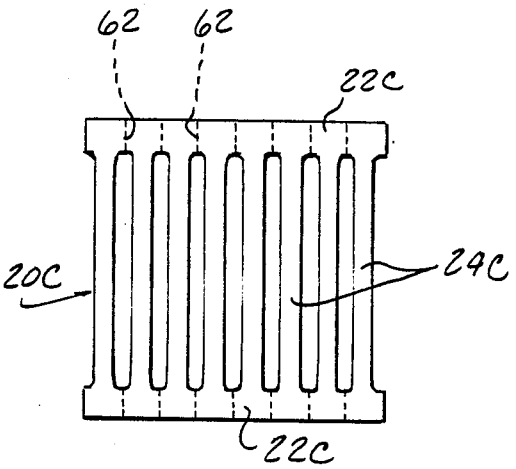
Figure 27:
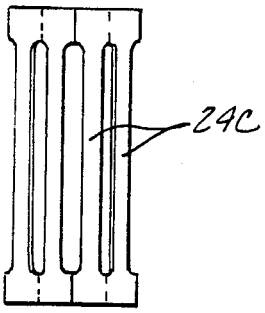
Figure 28:
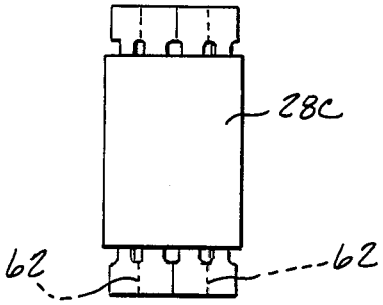
Figure 29:
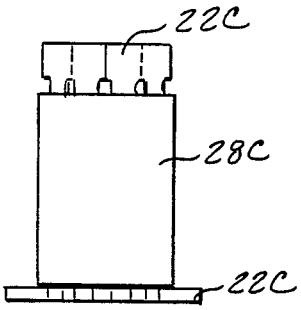
Figure 30:
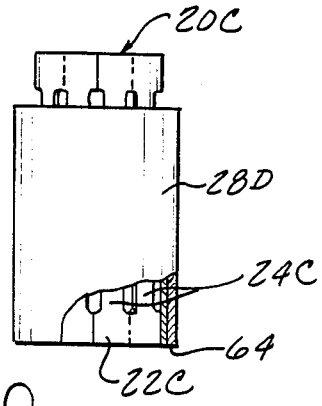

FIGS. 21, 22, 23, 24, and 25 show successive further steps in the construction of a barrel terminal from the blank of FIG. 19;

FIG. 26 is a top plan view of another embodiment of sheet metal blank for constructing a barrel terminal;

FIGS. 27, 28 and 29 show successive steps in the assembly of the blank of FIG. 26 into a barrel terminal; and FIG. 30 is a view similar to FIG. 28 showing a variation in the method of assembling a blank of FIG. 26 into a barrel terminal.

FIGS. 1–8 show the successive steps in the assembly of a barrel terminal as disclosed in our aforementioned parent application Ser. No. 824,116, whose disclosure is hereby incorporated herein by reference. This disclosure is included in the present application to show the relationship between the blank and method disclosed in that application and those of the present application and the adaptation of a basic method to the assembly of barrel terminals of different structure.

Figure 1:
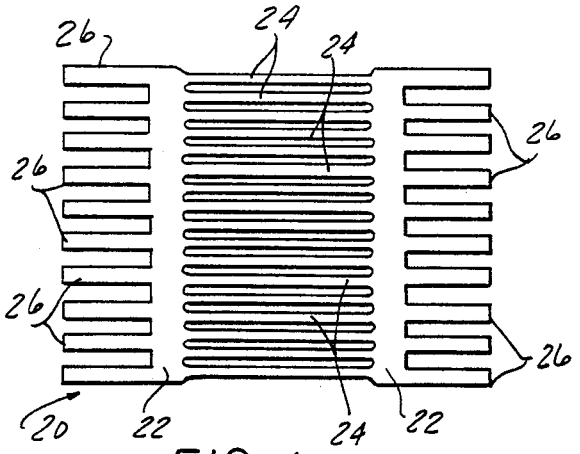
FIG. 1 is a top plan view of a sheet metal blank employed in constructing one form of barrel terminal according to the present invention.
Figure 7:
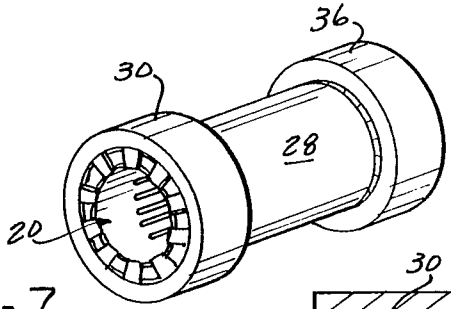
FIG. 7 is a perspective view of an assembled barrel terminal utilizing the blank of FIG. 1.
Figure 8:
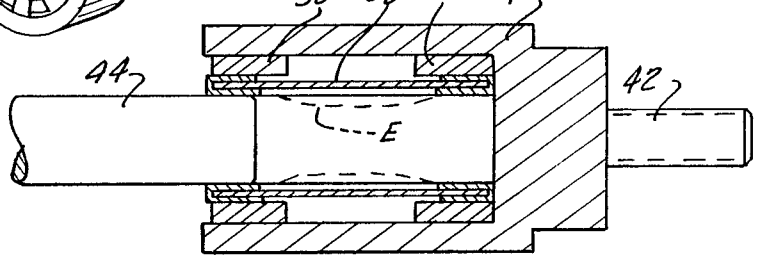
FIG. 8 is a cross-sectional view, with certain parts broken away or omitted, of an electrical connector employing the barrel terminal of FIG. 7.

A barrel terminal as shown in FIGS. 7 and 8 of the drawings is constructed by first forming a flat sheet metal blank, as by a stamping operation, into the configuration shown in FIG. 1. The blank, designated generally 20, is formed with a pair of transversely extending connecting webs 22 integrally joined to each other by a plurality of spaced parallel elongate contactor strips 24. A plurality of spaced parallel longitudinally extending tabs 26 extend outwardly from the outer edge of each connecting web 22.

Figure 2:
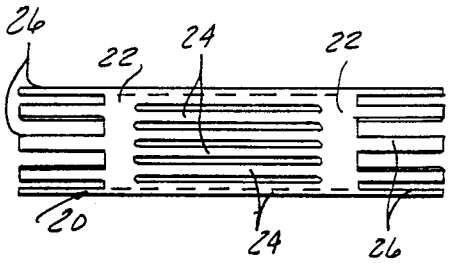
FIG. 2 is a side elevational view of the blank of FIG. 1 formed into a cylinder.
Figure 3:
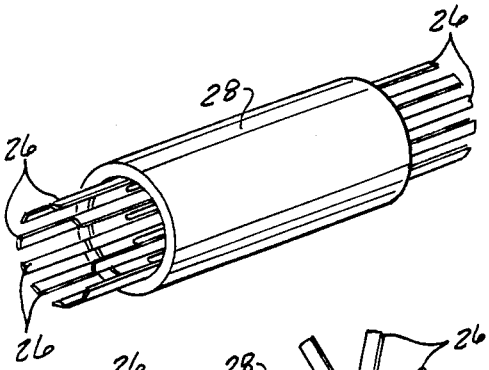
FIG. 3 is a perspective view showing a close fitting cylindrical sleeve received upon the blank of FIG. 2.

In FIG. 2, the blank of FIG. 1 is shown formed into a hollow cylindrical tube which is then inserted into a close fitting hollow cylindrical sleeve 28 as in FIG. 3, with the tabs 26 projecting from the opposite ends of sleeve 28.

Figure 4:
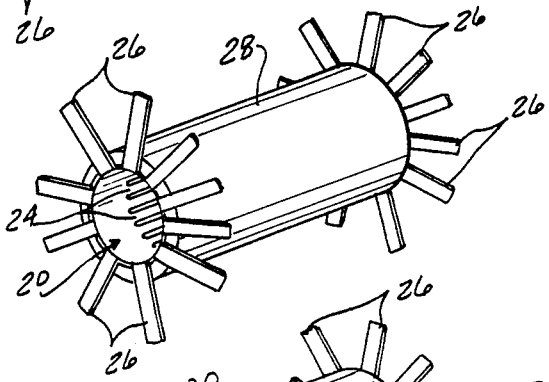
FIG. 4 is a perspective view of a subsequent step in the construction of a barrel terminal from the blank of FIG. 1.
Figure 5:
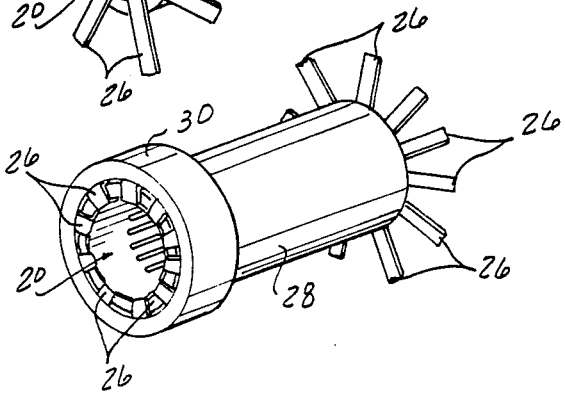
FIG. 5 is a perspective view showing the next subsequent step in the construction of a barrel terminal from the blank of FIG. 1.
Figure 6:
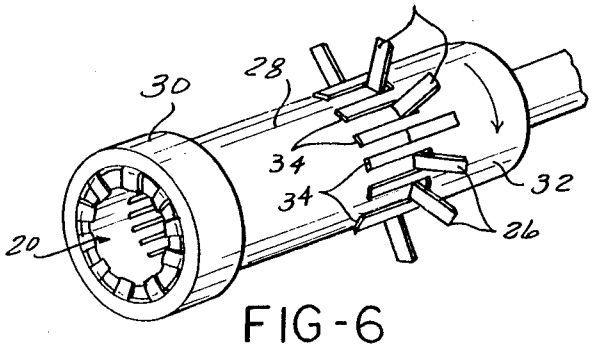
FIG. 6 is a perspective view showing the next subsequent step in the construction of a barrel terminal from the blank of FIG. 1.

In FIG. 4, the next step in the assembly process finds the tabs 26 being bent over the respective ends of sleeve 28 to project radially outwardly from the sleeve.

In the next step a tight fitting annular ring or collar 30 is press fitted over one end of sleeve 28 to fixedly clamp the tabs 26 at that end in face-to-face engagement with the exterior of sleeve 28.

Figure 10:
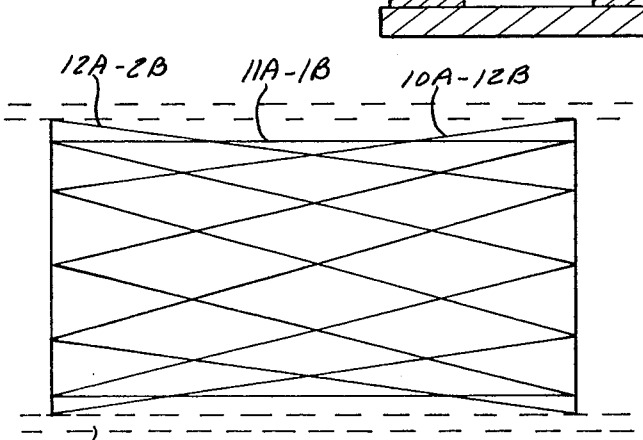
FIGS. 9 and 10 are schematic diagrams illustrating the relationship of the longitudinal strips of a barrel terminal in their final assembled relationship.
Figure 9:
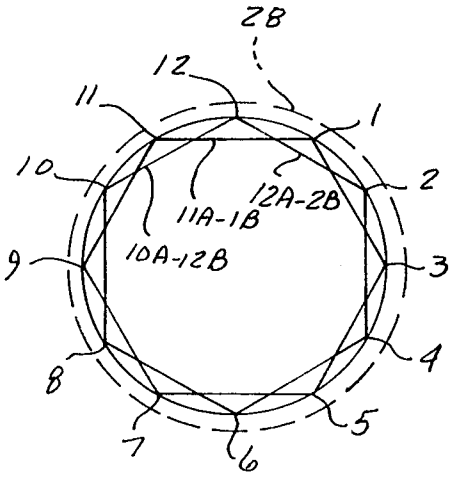

In the next step a hollow tubular tool 32 having circumferentially spaced teeth 34 is engaged between the radially projecting tabs 26 and rotated about the axis of sleeve 28 through a predetermined angle while sleeve 28 is held stationary. This angularly offsets the individual contactor strips 24 into a skewed relationship to the axis of sleeve 28, schematically illustrated in FIGS. 9 and 10, to cause the strips collectively to define a slightly concave hourglass shaped envelope in the interior of sleeve 28 in a manner described in more detail in our parent application Ser. No. 824,116.

In FIGS. 11–18, a modified form of barrel terminal is disclosed. In the embodiment of FIGS. 11–18, a flat sheet metal blank designated generally 20*a* is formed in a stamping operation in which the blank as formed is connected to a carrying strip 46 by a link portion 48. Strip 46 may be of indeterminant length and have successive like blanks 20*a* progressively stamped at spaced intervals as an elongate strip of sheet metal stock is fed through the stamping machine and advanced to carry the blanks 20*a* to and through a series of work stations. It will be appreciated that the location on the blank 20*a* which is connected to strip 46 may be varied in accordance with the tooling employed.

The blank 20*a* is formed with a single connecting web 22*a* having a plurality of spaced parallel contactor strips 24*a* projecting from one side edge of web 22*a* and a plurality of relatively short "tabs" 26*a* projecting from the opposite edge of web 22*a*.

Figure 11:
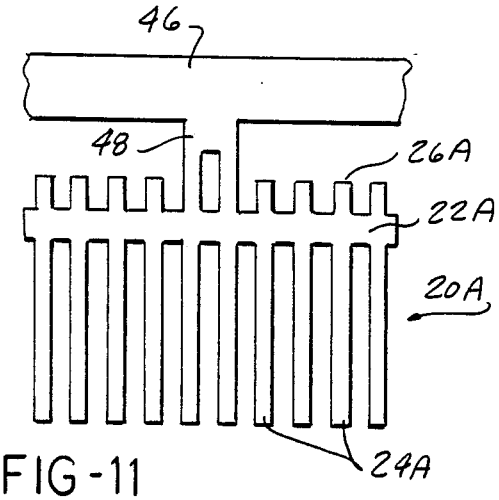
FIG. 11 is a top plan view of a second embodiment of flat sheet metal blank employed in the construction of a first modified form of barrel terminal.
Figure 12:
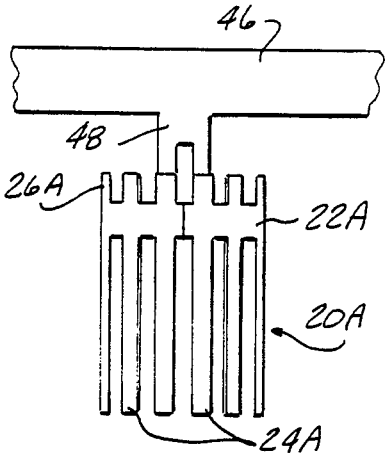
FIG. 12 is a top plan view showing the blank of FIG. 11 formed into a hollow cylindrical configuration.

After the blank is formed flat as shown in FIG. 11, it is then formed into a hollow cylindrical tube as shown in FWIGg. 12.

Figure 13:
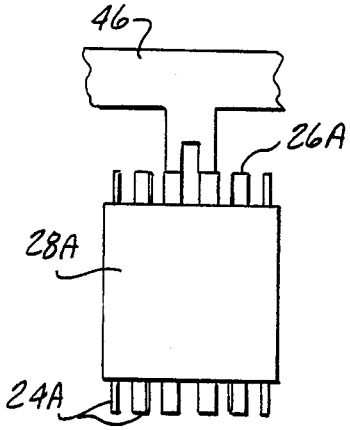
FIG. 13 is a top plan view showing a cylindrical sleeve fitted onto the blank of FIG. 12.

In the next assembly step shown in FIG. 13, a close fitting cylindrical sleeve 28*a* is slipped onto the tubular blank, the length of sleeve 28*a* being such that "tabs" 26*a* project axially from one end of the sleeve while the end portions of contactor strips 24*a* project axially from the opposite end of the sleeve.

Figure 14:
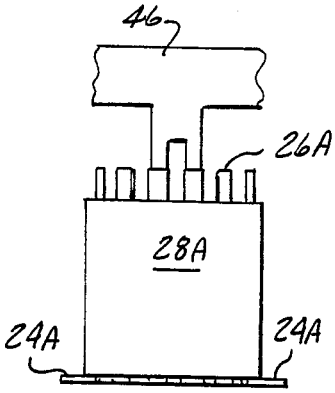
FIG. 14 is a subsequent step in the manufacture of a barrel terminal from the bent blank of FIG. 11.

In the next step, as shown in FIG. 14, the projecting ends of contactor strips 24*a* are bent from the position shown in FIG. 13 radially outwardly across the adjacent edge of sleeve 28*a* to project radially outwardly from the axis of sleeve 28*a*. A close fitting collar 30*a* is then press fitted onto the lower end of sleeve 28*a*, as viewed in FIG. 15, to bend the projecting ends of the contactor strips 24*a* into face-to-face engagement with the exterior of the sleeve to fixedly clamp the strips 24*a* to the sleeve at its lower end as viewed in FIG. 15.

The steps illustrated in FIGS. 11–15 may all be performed while the blank 20*a* remains attached to strip 46, and, as stated above, strip 46 may be employed to carry the components of the terminal being assembled from one work station to the next.

Figure 15:
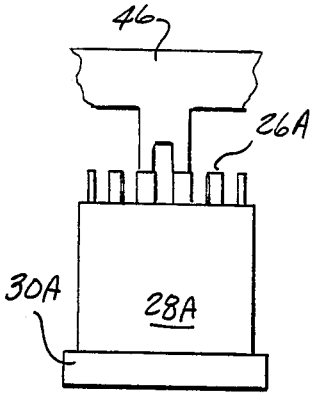
FIGS. 15, 16, 17 and 18 show further successive steps in the construction of a barrel terminal from the blank of Fig. 11.
Figure 16:
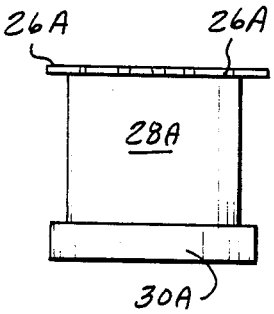
Figure 17:
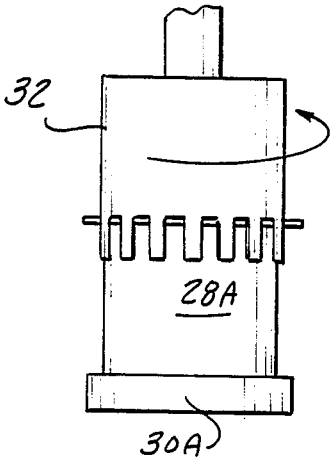
Figure 18:
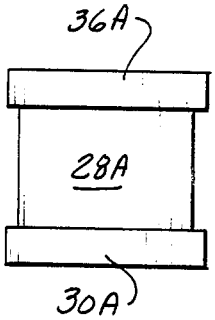

After the collar 30*a* has been press fitted as shown in FIG. 15, the assembly is severed from strip 46 and the upwardly projecting "tabs" 26*a* are then flared radially outwardly across the upper edge of sleeve 28*a* as viewed in FIG. 16, the tool 32 (FIG. 6) is then employed as in the previously described embodiment to angularly offset one end of the contactor strips 24a from the other as previously described, and after this offsetting step is performed, a second collar 36a is press fitted in place as described above to complete the assembly.

The embodiment of FIGS. 11–18 differs from the embodiment of FIGS. 1–8 primarily in that only one connector web 22a is employed and the flat metal blank which constitutes the contactor strips is formed integrally with a carrying strip 46.

Another embodiment of barrel terminal is shown in FIGS. 19–25. In this embodiment, as shown in FIG. 19, a flat sheet metal blank 20b is formed with a solid generally rectangular portion 50 having a plurality of spaced parallel contactor strips 24b projecting perpendicularly from one edge 52 of rectangular portion 50. The remaining three edges of rectangular portion 50 are identified respectively by reference numerals 54, 56 and 58.

Figure 20:
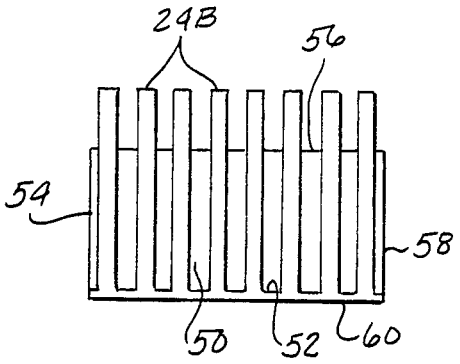
FIG. 20 is a top plan view showing an initial step in the assembly of the blank of FIG. 19 into a barrel terminal.

The next step in the assembly of a barrel terminal from the blank 20b is illustrated in FIG. 20 and finds the rectangular portion 50 folded about a fold line 60 extending in adjacent parallel relationship to edge 52 through 180° into flat face-to-face engagement with one side of contactor strips 24b. As best seen in FIG. 20, the strips 24b project beyond the edge 56 of the folded rectangular portion 50.

Figure 21:
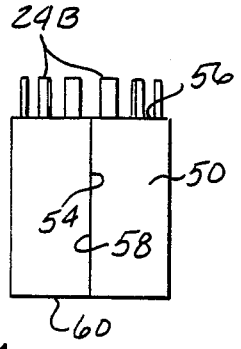
Figure 22:
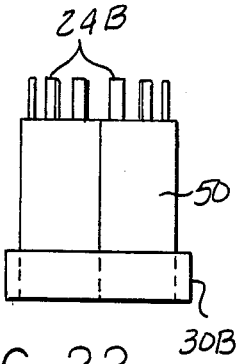
Figure 23:
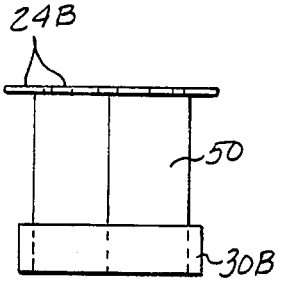
Figure 24:
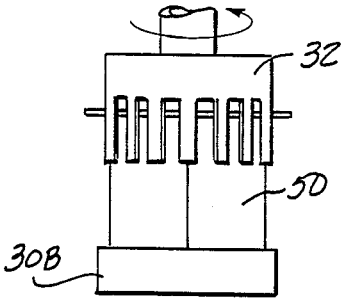
Figure 25:
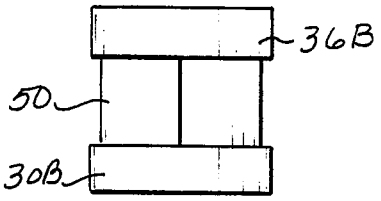

The folded blank of FIG. 20 is then formed into a hollow tubular configuration as shown in FIG. 21 with the opposite side edges of rectangular portion 50, edges 54 and 58, located in face-to-face engagement with each other. The rectangular portion 50 of blank 20b has now been transformed into the equivalent of the hollow cylindrical sleeve 28, 28a of the two previously described embodiments. An annular collar 30b is force fitted onto the lower end of the assembly as in FIG. 22.

The remainder of the assembly proceeds as in the previously described embodiments, with the projecting ends of strips 24b being bent radially outwardly (FIG. 23), then rotated by tool 32 (FIG. 24) and finally clamped to the exterior of the cylindrical sleeve by force fitting an annular collar 36b as in the previous embodiments. Although not so illustrated, it will be appreciated that the blank 20b of FIGS. 19–25 could be formed integrally with a carrying strip 46 as described above in connection with the FIGS. 11–18 embodiment.

Still another embodiment is illustrated in FIGS. 26–29. In this embodiment, a flat generally rectangular blank 20c is formed with connecting webs 22c extending along and constituting two opposed parallel edges of the blank. A plurality of spaced parallel contactor strips 24c are integrally joined at their opposite ends to strips 22c. Score lines 62 are formed in the connecting webs 22c to extend laterally across the webs between adjacent pairs of contactor strips 24c.

As in previously described embodiments, after the flat blank is formed it is rolled into a hollow cylindrical tube (FIG. 27) and inserted into a close fitting hollow cylindrical sleeve 28c as shown in FIG. 28. The axial length of sleeve 28c is such that the connecting webs 22c and adjacent end portions of contactor strips 24c project axially outwardly beyond the opposite ends of the sleeve.

The connecting web 22c at one end of sleeve 28c is then radially expanded to break the connecting web at each of score lines 62 so that the projecting portions of the contactor strips 24c and their attached segments of the now broken connecting web 22c may be flared radially outwardly across the adjacent end edge of sleeve 28c. A collar, now shown, is then force fitted onto that end of the sleeve 28c as in the previous cases.

The connector web at the opposite end of sleeve 28c is then similarly radially expanded to segment the connecting web and the projecting portions bent radially outwardly across the edge of sleeve 28c. The rotating tool 32 of the previously described embodiments is then employed to angularly offset this end of the connector strips and a second collar, not shown, is force fitted to clamp the strips in face-to-face engagement with the exterior of sleeve 28c.

Still another embodiment is illustrated in FIG. 30. In the embodiment of FIG. 30, a blank 20c as illustrated in FIG. 26 is formed, rolled into a hollow cylindrical configuration and inserted within a close fitting hollow cylindrical sleeve 28d. In the embodiment shown in FIG. 30, the lower edge of the inserted blank 20c is lined up with the lower edge of sleeve 28d. The sleeve and blank are then welded to each other along their adjacent edges as at 64. It is not necessary in this particular embodiment that the lower connecting web 22c be scored. The connecting web 22c at the upper end of the assembly of FIG. 30 is then radially expanded, flared, rotated and clamped by a collar as in the embodiment of FIGS. 26–29.

The metal from which the various flat metal blanks are stamped is preferably a beryllium copper alloy which has both mechanical and electrical properties well suited to this particular application. It will be appreciated that the overall dimensions of barrel terminals made in accordance with the present invention will vary in accordance with the specific application. A typical terminal may have an axial length of about one inch with an internal diameter of the cylindrical sleeve being approximately one half inch. For terminals of these dimensions, a rotary offset, produced by the use of the tool 32, of approximately 15 to 20 degrees between the circumferential position of one end of a contactor strip to the other, will result in a reduction in the internal radius between the midpoints of the contactor strips of about 30 to 40 one thousandths of an inch. The properties of the beryllium copper alloy are such that the metal will set at the angular displacement produced by operation of the tool 32, while the contactor strips possess sufficient resilience to clamp an inserted cylindrical contact quite firmly while accommodating manual insertion or withdrawl of the contact from the barrel terminal.

While various embodiments of the invention have been described, it will be appreciated that the embodiments which have been described may be modified. Therefore, the foregoing description is to be considered exemplary rather than limiting, and the true scope of the invention is that defined in the following claims.

We claim:

1. The method of making a barrel terminal comprising the steps of:

A. forming a flat sheet metal blank with a plurality of elongate strips integrally connected in spaced parallel relationship to each other by at least one connecting web extending transversely of said strips adjacent one end of said strips, B. positioning said strips within a hollow cylindrical sleeve with said strips lying against the inner surface of said sleeve in parallel relationship to the axis of said sleeve and with end portions of said strips projecting axially from at least one end of said sleeve, C. angularly displacing the end portions of said strips at said one end of said sleeve relative to said sleeve about the sleeve axis while holding the strips at the opposite end of said sleeve in fixed relationship to said sleeve, and D. fixedly securing the angularly displaced end portions to said sleeve at said one end thereof.

2. The method defined in claim 1 wherein the step of forming said flat blank comprises the further steps of forming the blank in a generally rectangular overall configuration with spaced parallel slots extending inwardly from one edge of said blank to define said elongate strips with the remainder of said blank constituting a rectangular connecting web integrally joined along one edge to said strips, and wherein the step B of positioning said strips comprises the steps of folding the flat blank along a fold line adjacent and parallel to said one edge of said web to locate said web in flat face-to-face engagement with said strips, and bending the flat folded blank into a hollow cylinder with said strips located at the inner side of said web with said web now constituting said cylindrical sleeve.

3. The method defined in claim 2 comprising the further step of fitting an annular collar around the end of said hollow cylinder adjacent said fold line prior to performing step C.

4. The method defined in claim 1 wherein the step A of forming said blank includes the steps of forming said connecting web at a location spaced from one end of said strips such that a first group of said strips project a relatively short distance from one side of said web and second group of strips projects a relatively greater distance from the opposite side of said web, and wherein the step B of positioning said strips comprises the steps of forming the flat blank into a hollow cylinder having an axis extending parallel to said strips, and inserting said hollow cylinder into a close fitting hollow cylindrical sleeve of an axial length such that said first group of strips projects from one end of said sleeve and said second group of strips projects from the opposite end of said sleeve.

5. The method defined in claim 1 wherein the step A of forming said flat metal blank comprises the futher steps of forming the blank in a generally rectangular configuration with connecting webs extending along two opposed side edges of said blank and said strips integrally joined at opposite ends to said webs, and forming score lines across at least one of said webs between each pair of adjacent strips, and wherein the step B of positioning the strips includes the step of locating the sleeve axially relative to the strips so that the connecting web connecting the projecting end portions of said strips is a web having score lines, and subsequent to the completion of step B performing the step of flaring the projecting end portion radially outwardly of said sleeve to separate the last mentioned connecting web along the score lines.

6. The method defined in claim 5 wherein the step A of forming said blank includes the step of forming said score lines on only one of said connecting webs while leaving the other web unscored and wherein the step B of positioning the strips includes the step of locating the edge of the unscored web at an end of said sleeve, and comprising the further steps of welding said unscored web to said sleeve.

7. The method defined in claim 5 wherein the step A of forming the blank includes the step of forming said score line on both of said connecting webs and the step B of positioning said strips includes the step of locating the sleeve axially of said strip so that opposite end portions of said strips project from opposite ends of said sleeve.

8. A barrel terminal comprising a hollow cylindrical sleeve, a plurality of elongate contactor strips located within said sleeve and extending in straight line paths between respective first circumferential locations on said sleeve adjacent a first end of said sleeve to respective corresponding second circumferential locations on said sleeve adjacent the opposite end of said sleeve, each first circumferential location on said sleeve bing angularly displaced about the axis of said sleeve from its corresponding second circumferential location, first means fixedly securing said strips in mechanical and electrical contact with said sleeve at said first locations, and second means fixedly securing said strips in mechanical and electrical contact with said sleeve at said second locations, at least one of said first and said second means comprising reversly bent tab portions integrally connected to said strips and lying in face-to-face engagement with the exterior of said sleeve at circumferentially spaced locations, at one end of said sleeve and an annular collar fixedly clamping said tab portions against the exterior of said sleeve.

9. The invention defined in claim 8 wherein only one of said first and said second means comprises tab portions lying in face-to-face engagement with the exterior of said sleeve, and the other of said first and second means comprises means integrally joining each strip to said sleeve at the other end of said sleeve.

10. The invention defined in claim 9 wherein said sleeve comprise a sheet metal member having a pair of opposite end edges defining the opposite ends of said sleeve and a pair of side edges disposed in adjacent opposed side by side relationship extending axially of said sleeve, said strips being integrally joined to said member at one of said end edges and said tab portions being reversly bent around the other of said end edges, and an annular collar seated upon the exterior of said sleeve at said one of said end edges.

11. The invention defined in claim 8 wherein said at least one of said first and said second means comprises a circumferentially extending connecting web integrally connecting said strips to each other and to said tab portions.

* * * * *